US007132043B1

(12) United States Patent
Duprey et al.

(10) Patent No.: US 7,132,043 B1
(45) Date of Patent: Nov. 7, 2006

(54) PROCESS TO PREPARE A LUBRICATING BASE OIL

(75) Inventors: Eric Duprey, Grand Couronne (FR); Jean-Paul Fattaz, Petit Couronne (FR); Roland Albert Charles Garin, Grand Couronne (FR); Patrick Moureaux, Grand Couronne (FR)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/979,964

(22) PCT Filed: May 26, 2000

(86) PCT No.: PCT/EP00/04983

§ 371 (c)(1),
(2), (4) Date: Nov. 27, 2001

(87) PCT Pub. No.: WO00/73402

PCT Pub. Date: Dec. 7, 2000

(30) Foreign Application Priority Data

May 28, 1999 (EP) ..... 99401286

(51) Int. Cl.
*C10G 45/00* (2006.01)

(52) U.S. Cl. ..... 208/89; 208/143; 208/27; 208/28; 208/108; 208/111; 208/110; 208/138; 208/142; 208/144

(58) Field of Classification Search ..... 208/89, 208/143, 27, 28, 108, 111, 110, 138, 142, 208/144
See application file for complete search history.

(56) References Cited

U.S. PATENT DOCUMENTS 3,673,078 A 6/1972 Kirk, Jr. ..... 208/89
4,622,129 A * 11/1986 Bayle et al. ..... 208/87
5,614,079 A * 3/1997 Farnos et al. ..... 208/27
5,786,293 A * 7/1998 Lockemeyer ..... 502/216
5,855,767 A 1/1999 Prescott et al.
6,051,127 A * 4/2000 Moureaux ..... 208/58

FOREIGN PATENT DOCUMENTS

| | | | |
|---|---|---|---|
| EP | 0181254 | A1 | 10/1985 |
| EP | 0329499 | A1 | 1/1989 |
| EP | 0448435 | A1 | 3/1991 |
| EP | 0564317 | A1 | 3/1993 |
| WO | 93/02793 | | 2/1993 |
| WO | 94/10263 | | 5/1994 |
| WO | 94/25157 | | 11/1994 |
| WO | 98/02503 | | 1/1998 |
| WO | WO 9801515 | A1 * | 1/1998 |

OTHER PUBLICATIONS

"Lubricating Base Oil and Wax Processing," by Avilino Sequeira, Jr. 1994, Marcel Dekker Inc. New York, pp. 81-118.

* cited by examiner

*Primary Examiner*—Tam M. Nguyen
(74) *Attorney, Agent, or Firm*—Charles W. Stewart

(57) ABSTRACT

Process to prepare a lubricating base oil starting from a lubricating base oil which is obtained by first removing part of the aromatic compounds from a petroleum fraction boiling in the lubricating oil range by solvent extraction and subsequently dewaxing the solvent extracted product, wherein the following steps are performed, (a) contacting the lubricating base oil with a suitable sulphided hydrotreating catalyst in a first hydrotreating step; (b) separating the effluent of step (a) into a gaseous fraction and a liquid fraction; (c) contacting the liquid fraction of step (b) with a catalyst comprising a noble metal component supported on an amorphous refractory oxide carrier in the presence of hydrogen in a second hydrotreating step; and (d) recovering the lubricating base oil.

16 Claims, No Drawings

PROCESS TO PREPARE A LUBRICATING BASE OIL

The invention relates to a process to prepare a lubricating base oil having a saturates content of more than 90 wt %, a sulphur content of less than 0.03 wt % and a viscosity index of between 80–120. Such a base oil is sometimes referred to as a API Group II base oils as defined in API Publication 1509: Engine Oil Licensing and Certification System, "Appendix E-API Base Oil Inter-changeability Guidelines for Passenger Car Motor Oil and Diesel Engine Oils". There exist an increasing demand for these products due to the fact that modern automobile engines operate under more severe conditions, requiring a lubricating oil which is formulated based on a base oil having the above specifications. The API Group II base oils are also valuable for Industrial Lubricants, because of their improved inhibited oxidation stability.

Lubricating base oils are conventionally prepared starting from a vacuum distillate or a deasphalted vacuum residue. These distillates are obtained by first distilling a petroleum crude feedstock at atmospheric conditions wherein a residue is obtained, which residue is subsequently distilled at reduced pressure obtaining vacuum distillates and a vacuum residue. Aromatics are removed from the vacuum distillate by means of solvent extraction resulting in a aromatic-poor solvent extracted product. In a subsequent step wax is removed from the solvent extracted product and a lubricating base oil product is obtained. Typically the wax is removed by solvent dewaxing. It has been found that the API Group II base oil product cannot be easily obtained by such a process from most petroleum crude sources. An overview of typical routes to API Group I and II base oils is for example described in Oil & Gas Journal, Sep. 1, 1997, pages 63–70.

U.S. Pat. No. 5,855,767 describes a process to prepare a base oil product having a saturates content of above 90 wt % and a VI of about 100 by hydrogenation of a feed containing about 5 ppm of total sulphur and nitrogen compounds using a catalyst containing either platinum or palladium and a zeolite Y. The feed may be obtained by means of solvent extraction of a petroleum fraction boiling in the lubricating oil range, followed by solvent dewaxing and a combined hydrodesulphurisation (HDS) and hydrodenitrogenation (HDN) step.

A disadvantage of the process according to WO-A-5855767 is that when starting from a petroleum fraction boiling in the lubricating oil range containing high levels of sulphur and/or nitrogen compounds severe conditions have to be applied in the combined HDS/HDN step in order to reduce the sulphur and nitrogen content to the 5 ppm level as described in WO-A-5855767.

WO-A-9802502 describes a process to prepare API Group II base oils by performing a HDS/HDN step on a petroleum fraction boiling in the lubricating oil range at 360° C. at 100 bar using a Nickel-Molybdenum on alumina catalyst, catalytic dewaxing the hydrotreated product and hydrofinishing the dewaxed product using a platinum-palladium on silica-alumina catalyst at 232° C. and 77 bar. In the hydrofinishing step the majority of the aromatic compounds are saturated. The feedstock may have been subjected to a solvent extraction prior to the first hydrotreating step in which the viscosity index of the solvent extracted product is about 5–20 less than the desired viscosity index of the API Group II base oil.

A disadvantage of the process described in WO-A-9802502 is that relatively severe reaction conditions are applied in the first hydrotreating step. Another disadvantage is that additional cooling is required between the two hydroprocessing steps because of the large difference in operating temperature.

U.S. Pat. No. 3,673,078 describes in a process in which a feedstock obtained by solvent dewaxing of a furfural raffinate of a vacuum distillate of a paraffinic crude oil is subjected to a two step hydroprocessing process. The feedstock contains less than 800 ppm sulphur. The catalyst used in the first step was a sulphided NiCoMo containing catalyst. The temperature was about 403° C. and the pressure was about 102 bar. The catalyst in the second step was a platinum on alumina catalyst and the operating conditions were those of the first step.

A disadvantage of the process described U.S. Pat. No. 3,673,078 is that relatively severe reaction conditions are applied in the first hydrotreating step.

The object of the present invention is to provide a process which can prepare API Group II Base Oils under mild hydrotreating conditions starting from a petroleum fraction boiling in the lubricating oil range containing high levels of sulphur and/or nitrogen compounds.

This object is achieved by the following process. Process to prepare a lubricating base oil having a saturates content of more than 90 wt %, a sulphur content of less than 0.03 wt % and a viscosity index of between 80–120 starting from a lubricating base oil product having a saturates content of below 90 wt % and a sulphur content of between 300 ppmw and 2 wt %, which base oil product is obtained by first removing part of the aromatic compounds from a petroleum fraction boiling in the lubricating oil range by means of solvent extraction resulting in a solvent extracted product and subsequently dewaxing the solvent extracted product, wherein the following steps are performed, (a) contacting the lubricating base oil product with a suitable sulphided hydrotreating catalyst in the presence of hydrogen in a first hydrotreating step at a temperature of between 250 and 350° C.;
(b) separating the effluent of step (a) into a gaseous fraction and a liquid fraction, wherein the liquid fraction has a sulphur content of between 50 and 1000 ppmw and a nitrogen content of less than 50 ppmw;
(c) contacting the liquid fraction of step (b) with a catalyst comprising a noble metal component supported on an amorphous refractory oxide carrier in the presence of hydrogen in a second hydrotreating step; and
(d) recovering the lubricating base oil having the specified properties.

Applicants have found that an API Group II base oil can be prepared by a two step hydrotreating process under less severe conditions when the feedstock is base oil product obtained by solvent extraction and (solvent) dewaxing process as described above. An additional advantage is that the desired product can be made using widely available feedstock, namely base oils obtained by solvent extraction and dewaxing. These base oils do not necessarily have to be prepared at the same location as where the process according the invention takes place. This is advantageous when existing hydrotreating facilities to prepare base oils are not at the same location as the solvent extraction and dewaxing facilities.

A further advantage is that the capacity of first hydrotreating step (a) of the process according to the invention can be lower than the first hydrotreating step of the process of WO-A-9802502 for the same capacity of API Group II base oils. This is because, contrary to the present invention, in the prior art process a certain volume of wax is present during the hydrotreating step. Another advantage is that because the operating temperatures of step (a) and step (c) can be close to each other less or no intermediate cooling is required.

For this invention the sulphur and nitrogen content expressed in weight percentage or ppmw is the amount of elemental sulphur or nitrogen relative to the total amount of the mixture referred to.

The base oil feedstock having a saturates content of below 90 wt % is obtained by solvent extraction and dewaxing of a petroleum fraction boiling in the lubricating oil range. Suitable distillate petroleum fractions are vacuum distillate fractions derived from an atmospheric residue, i.e. distillate fractions obtained by vacuum distillation of a residual fraction which in return is obtained by atmospheric distillation of a crude oil. The boiling range of such a vacuum distillate fraction is usually between 300 and 620° C., suitably between 350 and 580° C. However, deasphalted residual oil fractions, including both deasphalted atmospheric residues and deasphalted vacuum residues, may also be applied.

Solvent extraction is a widely applied technology when preparing base oils and is for example described in "Lubricating base oil and wax processing", by Avilino Sequeira, Jr., 1994, Marcel Dekker Inc. New York, pages 81–118. Solvent extraction is suitably performed with for example N-methyl-2-pyrrolidone, furfural, phenol and sulphur dioxide as extraction solvent. Often used solvents are N-methyl-2-pyrrolidone and furfural. In the solvent extraction aromatic compounds are partly removed from the hydrocarbon mixture, thereby increasing the viscosity index of the product. Amounts of sulphur and nitrogen are also removed in the solvent extraction process.

Dewaxing is also a widely applied technology when preparing base oils. Possible dewaxing methods include catalytic dewaxing and solvent dewaxing which are described in the earlier mentioned textbook "Lubricating base oil and wax processing", by Avilino Sequeira, Jr., 1994, Marcel Dekker Inc. New York, pages 153–224. An example of a catalytic dewaxing technology is described in the afore-mentioned WO-A-9802502. For the present invention it is not critical how the dewaxing step is operated in order to obtain the lubricating base oil starting product which is fed to step (a). The feedstocks containing relatively high levels of sulphur used in the present invention are more likely to be obtained by solvent dewaxing because most catalytic dewaxing processes are sensitive to high levels of sulphur.

Solvent dewaxing is performed by chilling the feedstock with a solvent whereby the wax molecules crystallise. The wax crystals are subsequently removed by filtration and the solvent is recovered. Examples of possible solvents are methylethylketone/toluene, methylisobutylketone, methylisobutylketone/methylethyl-ketone, dichloroethylene/methylenechloride, and propane.

The lubricating base oil starting product which is fed to step (a) as obtained by solvent extraction and (catalytic or solvent) contains less than 90 wt % saturates and has a sulphur content of between 300 ppmw and 2 wt %. The process according to the invention has been found to perform particularly good compared to prior art processes when the feedstock contains relatively high amounts of sulphur, like more than 1000 ppmw. The nitrogen content is preferably less than 50 ppmw. The saturates content is preferably higher than 70 wt %. Next to saturates the base oil mainly consists of aromatic and polar compounds. Examples of polar compounds are specific sulphur and nitrogen containing compounds. The pour point is usually less than 0° C. Particularly suitable base oils to be used in the present invention are those which are classified as API Group I Base Oils as described in the afore-mentioned API Publication 1509: Engine Oil Licensing and Certification System, "Appendix E-API Base Oil Interchangeability Guidelines for Passenger Car Motor Oil and Diesel Engine Oils".

In the first hydrotreating step the level of sulphur and nitrogen is reduced and therefore this step may be considered to be a HDS/HDN step as described in the prior art. The catalyst to be used in the first hydrotreating step may therefore be any catalyst known to one skilled in the art which may catalyse the HDS and HDN reactions, for example as described in the afore mentioned U.S. Pat. No. 5,855,767. Suitable catalysts comprise at least one Group VIB metal component and at least one non-noble Group VIII metal component selected from the group of iron, nickel or cobalt supported on a refractory oxide carrier. Examples of suitable Group IVB metals are molybdenum (Mo) and tungsten (W). Examples of suitable non-noble Group VIII metals are nickel (Ni) and cobalt (Co). Suitable catalysts include those catalysts comprising as the non-noble Group VIII metal component one or more of nickel (Ni) and cobalt (Co) in an amount of from 1 to 25 percent by weight (wt %), preferably 2 to 15 wt %, calculated as element relative to total weight of catalyst and as the Group VIB metal component one or more of in an amount of from 5 to 30 wt %, preferably 10 to 25 wt %, calculated as element relative to total weight of catalyst. These metal components may be present in elemental, oxidic and/or sulphidic form and are supported on a refractory oxide carrier. The catalyst may also comprises a noble metal from Group VIII next to the above mentioned metals. Examples of suitable noble metals are palladium and platinum.

The refractory oxide support of the catalyst used in the first hydrotreating step may be any inorganic oxide, alumino-silicate or combination of these, optionally in combination with an inert binder material. Examples of suitable refractory oxides include inorganic oxides, such as alumina, silica, titania, zirconia, boria, silica-alumina and mixtures of two or more of these.

Phosphorus (P), which is a well known promoter, may also be present in the catalyst used in the first hydrotreating step. The phosphorous content is preferably between 1 and 10 wt % as oxide.

Preferred catalyst, more preferably containing a phosphorus promoter, are cobalt/molybdenum on alumina having a cobalt content of between 1–5 wt % as oxide and 10–25 wt % molybdenum content as oxide; nickel/molybdenum on alumina having a nickel content 1–5 wt % as oxide and a molybdenum content of between 10–30 wt % as oxide of which commercially available catalyst C-424 of Criterion Catalyst Company (Houston, Tex.) is an example; and nickel/tungsten on alumina having a nickel content of between 1–5 wt % as oxide and a tungsten content of between 10–30 wt % as oxide.

Since the base oil feed to be converted in step (a) will contain sulphur-containing compounds, the catalyst used in the first hydrotreating step is at least partly sulphided prior to operation in order to increase its sulphur tolerance. Presulphiding of the catalyst can be achieved by methods known in the art, such as for instance those methods disclosed in the following publications EP-A-181254, EP-A-329499, EP-A-448435, EP-A-564317, WO-A-9302793 and WO-A-9425157.

In general, presulphiding is effected by contacting the unsulphided catalyst with a suitable sulphiding agent, such as hydrogen sulphide, elemental sulphur, a suitable polysulphide, a hydrocarbon oil containing a substantial amount of sulphur-containing compounds or a mixture of two or more of these sulphiding agents. Particularly for the in situ sulphidation a hydrocarbon oil containing a substantial amount of sulphur-containing compounds may suitably be used as the sulphiding agent. Such oil is then contacted with the catalyst at a temperature which is gradually increased from ambient temperature to a temperature of between 150 and 250° C. The catalyst is to be maintained at this temperature for between 10 and 20 hours. Subsequently, the temperature is to be raised gradually to the operating temperature. A particular useful hydrocarbon oil presulphiding agent may be the base oil feed itself, which contains a significant amount of sulphur-containing compounds. In this case the unsulphided catalyst may be contacted with the feed under, for example, the operating conditions, thus causing the catalyst to become sulphided. Typically, the base oil feed should comprise at least 0.5% by weight of sulphur-containing compounds, said weight percentage indicating the amount of elemental sulphur relative to the total amount of feedstock, in order to be useful as a sulphiding agent.

The first hydrotreating step is operated at relatively mild conditions. The temperature is between 250 and 350° C. The actual temperature will depend largely on the content of sulphur and/or nitrogen in the feed and the desired reduction to be achieved. Higher temperatures result in higher reduction of S- and N-content. The pressure may range from 10 to 250 bar, but preferably is between 20 and 100 bar. The weight hourly space velocity (WHSV) may range from 0.1 to 10 kg of oil per liter of catalyst per hour (kg/l.h) and suitably is in the range from 0.2 to 5 kg/l.h.

After the first hydrotreating step the effluent is separated in step (b), preferably at elevated pressure, into a liquid fraction and a gaseous fraction. The sulphur content of the liquid fraction obtained is between 50 and 1000 ppmw and the nitrogen content is said fraction is less than 50 ppmw. The gaseous fraction will contain hydrogen sulphide and ammonia as the S- and N-reaction products of the HDS and HDN reactions. The gaseous fraction will further contain any excess hydrogen which has not reacted in the first hydrotreating step as well as some light hydrocarbons. The gas-liquid separation may be carried out by any gas-liquid separation means known in the art, such as a high pressure stripper.

Suitably hydrogen sulphide and ammonia are removed from the gaseous fraction obtained in step (b) resulting in a cleaned hydrogen containing gas, which is preferably recycled to the first hydrotreating step. Examples of suitably methods for removing hydrogen sulphide and ammonia are methods known in the art, such as an absorption treatment with a suitable absorption solvent, such as solvents based on one or more alkanolamines (e.g. mono-ethanolamine, di-ethanol-amine, methyl-di-ethanol-amine and di-isopropanolamine).

In the second hydrotreating step (c) the liquid fraction obtained after a gas-liquid separation step (b) is contacted in the presence of hydrogen and a catalyst comprising a noble metal component supported on an amorphous refractory oxide carrier. In step (c) part of the aromatic compounds are hydrogenated to saturate compounds. The catalyst preferably comprises at least one noble Group VIII metal component supported on an amorphous refractory oxide carrier. Suitable noble Group VIII metal components are platinum and palladium. The catalyst suitably comprises platinum, palladium or both. The total amount of noble Group VIII metal component(s) present suitably ranges from 0.1 to 10 wt %, preferably 0.2 to 5 wt %, which weight percentage indicates the amount of metal (calculated as element) relative to total weight of catalyst.

It has been found particular important that the catalyst comprises an amorphous refractory oxide as the carrier material. Examples of suitable amorphous refractory oxides include inorganic oxides, such as alumina, silica, titania, zirconia, boria, silica-alumina, fluorided alumina, fluorided silica-alumina and mixtures of two or more of these. Of these, amorphous silica-alumina is preferred, whereby silica-alumina comprising from 5 to 75 wt % of alumina has been found to be particularly preferred. Examples of suitable silica-alumina carriers are disclosed in WO-A-9410263. Examples of suitable catalysts are catalyst comprising platinum or palladium on an amorphous silica-alumina carrier. More preferably the catalyst comprises platinum and palladium supported on an amorphous silica-alumina carrier. A most preferred catalyst comprises an alloy of palladium and platinum preferably supported on an amorphous silica-alumina carrier of which the commercially available catalyst C-624 and C-634 of Criterion Catalyst Company (Houston, Tex.) are examples. These platinum/palladium catalyst are advantageous because they deactivate less when the sulphur content of the feed to the second hydrotreating step is relatively high as is the case in the present invention.

The catalyst used in step (c) preferably does not contain zeolite material and more preferably not zeolite-Y, because these catalyst components may give rise to undesirable cracking reactions.

Operating conditions in step (c) suitably are comparable to the operating conditions in the first hydrotreating zone. The temperature will suitably does not exceed 350° C. and preferably is in the range of from 150 and 350° C., more preferably from 180 to 320° C. The operating pressure may range from 10 to 250 bar and preferably is in the range of from 20 to 100 bar. The WHSV may range from 0.1 to 10 kg of oil per liter of catalyst per hour (kg/1.h) and suitably is in the range from 0.5 to 6 kg/l.h.

The invention will be illustrated by the following non-limiting examples.

EXAMPLE 1

A base oil obtained by performing an extraction with furfural on a vacuum distillate followed by a solvent dewaxing step using methylethylketone/toluene having the properties as listed in Table 1 was contacted in a first hydrotreating step (a) with hydrogen and a commercial NiMo on alumina catalyst (C-424 of Criterion Catalyst Company (Houston, Tex.). The operating conditions were a hydrogen partial pressure of 50 bar, a WHSV of 1 kg/l/h, a recycle gas rate of 1000 Nl/kg and a temperature of 320° C.

The effluent obtained by the above procedure was then separated into a liquid and a gaseous fraction in a high pressure separator (step (b)). Sulphur content of the liquid fraction was 360 ppmw, nitrogen content was 4.5 ppmw.

The liquid fraction was subsequently treated in a second hydrotreating step (c) in the presence of freshly supplied hydrogen over a commercial PtPd on amorphous silica-alumina carrier (C-624 of Criterion Catalyst Company (Houston, Tex.). Hydrogen partial pressure and recycle gas rate were the same as applied in step (a). The temperature was 280° C.

The effluent of step (c) was recovered as the final product. The properties of the end product are listed in Table 1.

TABLE 1

| | base oil feed-stock(*) | API Group II BASE OIL |
|---|---|---|
| saturates (wt %) (ASTM D 2007) | 70.8 | 90.1 |
| polars (wt %) (ASTM D 2007) | 1.4 | 0.2 |
| aromatics (wt %) (ASTM D 2007) | 27.8 | 9.7 |
| sulphur (mg/kg) | 8200 | 203 |
| nitrogen (mg/kg) | 29 | 2.5 |
| Viscosity Index | 103 | 105 |
| viscosity at 100° C. (cSt) | 5.18 | 4.95 |
| viscosity at 40° C. (cSt) | 29.8 | 27.3 |
| pour point (° C.) | −17 | −13 |

(*)as obtained by solvent extraction and solvent dewaxing

EXAMPLE 2

Example 1 was repeated, except in that the temperature in step (c) was 290° C. The saturate content in the end product was 91.1 wt % and the aromatic content was 8.9 wt %.

EXAMPLE 3

Example 1 was repeated, except in that the temperature in step (c) was 300° C. The saturate content in the end product was 93.7 wt % and the aromatic content was 6.1 wt %.

The invention claimed is:

1. Process to prepare a lubricating base oil having a saturates content of more than 90 wt %, a sulphur content of less than 0.03 wt % and a viscosity index of between 80–120 starting from a lubricating base oil product having a saturates content of below 90 wt % and a sulphur content of between 300 ppmw and 2 wt %, which lubricating base oil product is obtained by first removing part of the aromatic compounds from a petroleum fraction boiling in the lubricating oil range by means of solvent extraction resulting in a solvent extracted product and subsequently dewaxing the solvent extracted product, wherein the following steps are performed, (a) contacting the lubricating base oil product with a suitable sulphided hydrotreating catalyst in the presence of hydrogen in a first hydrotreating step at a temperature of between 250 and 350° C.;

(b) separating the effluent of step (a) into a gaseous fraction and a liquid fraction, wherein the liquid fraction has a sulphur content of between 50 and 1000 ppmw and a nitrogen content of less than 50 ppmw;

(c) contacting the liquid fraction of step (b) with a catalyst comprising a noble metal component supported on an amorphous refractory oxide carrier, including amorphous silica-alumina but having an absence of a cracking effective amount of zeolite-Y in the presence of hydrogen in a second hydrotreating step; and (d) recovering the lubricating base oil having the specified properties.

2. The process of claim 1, wherein the hydrotreating catalyst in step (a) comprises at least one Group VIB metal component and a metal selected from the group consisting of iron, nickel and cobalt and a refractory oxide support.

3. The process of claim 2, wherein the catalyst of step (a) is a nickel/molybdenum on alumina catalyst having a nickel content 1–5 wt % as oxide and a molybdenum content of between about 10–30 wt % as oxide.

4. The process of claim 1, wherein the catalyst of step (c) comprises platinum and palladium and has an absence of a cracking effective amount of zeolite material, where in the total amount of platinum and palladium is between about 0.2 and 5 wt %.

5. The process of claim 4, wherein palladium and platinum are present as an alloy.

6. The process of claim 1, wherein the temperature in step (c) is between about 150 and 350° C.

7. The process of claim 1, wherein the pressure in step (a) and (c) is between about 20 and 100 bar.

8. The process of claim 1, wherein the lubricating base oil product is obtained by solvent extraction of a petroleum fraction boiling in the lubricating oil range, followed by solvent dewaxing.

9. The process of claim 1, wherein the lubricating base oil product is an API Group I base oil and the product obtained in step (d) is an API Group II base oil.

10. A process for preparing a lubricating base oil, said process comprises:

subjecting a petroleum fraction boiling in the lubricating oil range and having a high sulfur concentration to a solvent extraction using an extraction solvent to thereby remove from said petroleum fraction a portion of the aromatic compounds therein to provide a solvent extracted product;

subjecting said solvent extracted product to a solvent dewaxing step using a dewaxing solvent to thereby yield a lubricating base oil starting product having a saturates content below 90 wt % and a sulfur content of between 300 ppmw and 2 wt %;

hydrotreating said lubricating base oil starting product with a suitable sulphided hydrotreating catalyst in the presence of hydrogen in a first hydrotreating step at a temperature of between 250 and 350° C. to yield an effluent;

separating said effluent into a gaseous fraction and a liquid fraction, wherein the liquid fraction has a sulphur content of between 50 and 1000 ppmw and a nitrogen content of less than 50 ppmw;

contacting said liquid fraction with a catalyst comprising a noble metal component supported on an amorphous refractory oxide carrier, including amorphous silica-alumina, in the presence of hydrogen in a second hydrotreating step; and recovering said lubricating base oil having a saturates content of more than 90 wt %, a sulphur content of less than 0.03 wt % and a viscosity index between 80–120.

11. A process as recited in claim 10, wherein said extraction solvent is selected from the group consisting of N-methyl-2-pyrrolidone, furfural, phenol, and sulphur dioxide.

12. A process as recited in claim 11, wherein said noble metal component of said catalyst includes platinum and palladium, and wherein the total amount of platinum and palladium is between 0.2 and 5 wt %.

13. A process as recited in claim 12, wherein said catalyst further has an absence of a cracking effective amount of zeolite-Y.

14. A process as recited in claim 13, wherein said said catalyst further has an absence of a cracking effective amount of zeolite material.

15. A process as recited in claim 14, wherein said suitable sulphided hydrotreating catalyst comprises nickel and molybdenum on alumina wherein the nickel content of said sulphided hydrotreating catalyst is in the range of from 1 to 5 wt % as oxide and the molybdenum content of said sulphided hydrotreating catalyst is in the range of from 10 to 30 wt % as oxide.

16. A process as recited in claim 15, wherein said petroleum fraction boiling in the lubricating oil range is a vacuum distillate fraction having a boiling range of from 300 to 620° C.

* * * * *